US009752364B2

(12) United States Patent
James

(10) Patent No.: US 9,752,364 B2
(45) Date of Patent: Sep. 5, 2017

(54) HINGE

(71) Applicant: DOWCO, Inc., Manitowoc, WI (US)

(72) Inventor: Tim James, Manitowoc, WI (US)

(73) Assignee: Dowco, Inc., Manitowoc, WI (US)

( * ) Notice: Subject to any disclaimer, the term of this patent is extended or adjusted under 35 U.S.C. 154(b) by 9 days.

(21) Appl. No.: 14/732,937

(22) Filed: Jun. 8, 2015

(65) Prior Publication Data

US 2016/0356067 A1 Dec. 8, 2016

(51) Int. Cl.
*E05D 11/10* (2006.01)
*E05D 3/02* (2006.01)
*E05D 5/14* (2006.01)

(52) U.S. Cl.
CPC ..... *E05D 11/1014* (2013.01); *E05D 11/1007* (2013.01); *E05D 3/02* (2013.01); *E05D 5/14* (2013.01); *Y10T 16/5358* (2015.01)

(58) Field of Classification Search
CPC . E05D 11/10; E05D 11/1007; E05D 11/1014; E05D 11/1028; Y10T 16/54024; Y10T 16/540247; Y10T 16/54025; Y10T 16/5407
USPC ..... 403/95, 96, 97, 98, 100, 101, 102
See application file for complete search history.

(56) References Cited

U.S. PATENT DOCUMENTS 646,347 A * 3/1900 Betty ..... E06C 1/32 16/326
1,473,436 A * 11/1923 Leopold ..... B25G 1/063 16/326
1,639,009 A * 8/1927 Singley ..... A47B 91/00 182/163
2,145,307 A * 1/1939 Hunt ..... E05D 5/043 16/375
3,187,373 A * 6/1965 Fisher ..... E05D 11/1007 16/324
3,613,151 A * 10/1971 Anderson et al. .. E05D 11/1014 16/278
3,653,079 A * 4/1972 Bourgraf ..... A61G 1/003 24/611
3,801,208 A * 4/1974 Bourgraf ..... A61G 1/003 403/102
3,955,240 A * 5/1976 Schuh ..... E05D 11/1007 16/326
4,111,217 A * 9/1978 Victor ..... E04H 15/60 135/114
4,356,593 A * 11/1982 Heininger ..... A47D 7/00 16/251
4,577,986 A * 3/1986 Wang ..... E06C 1/32 16/325
5,058,239 A * 10/1991 Lee ..... E06C 1/32 16/324

(Continued)

FOREIGN PATENT DOCUMENTS

EP 2727494 5/2014

*Primary Examiner* — Jeffrey O Brien
(74) *Attorney, Agent, or Firm* — Shane Delsman; Godfrey & Kahn, S.C.

(57) ABSTRACT

A hinge can be used between two structures to allow the structures to be quickly and easily folded and unfolded. The hinge has a first portion connected to a structure and a second portion connected to a structure. The first and second portions are also connected to one another. A latch is connected to one of the portions. The latch is biased towards a locked position such that when the hinge is unfolded, the hinge is prevented from being folded.

16 Claims, 13 Drawing Sheets

(56) References Cited

U.S. PATENT DOCUMENTS 5,251,359 A * 10/1993 Finkl ..... E05D 11/06 16/348
5,353,892 A * 10/1994 Lu ..... E06C 1/32 16/328
5,380,113 A * 1/1995 Boehm ..... A01K 77/00 16/319
5,413,063 A * 5/1995 King ..... B63B 17/04 114/221 R
5,440,948 A * 8/1995 Cheng ..... B62K 15/006 280/278
5,457,828 A * 10/1995 Huang ..... A47D 13/063 16/347
5,539,957 A * 7/1996 Schmidt ..... A63B 63/004 16/254
5,611,552 A 3/1997 Miles et al.
5,681,045 A * 10/1997 Liao ..... A63B 63/004 273/400
5,685,660 A * 11/1997 Liao ..... E05D 11/1007 384/585
5,730,449 A 3/1998 Miles
5,938,223 A * 8/1999 Kotlier ..... B62K 13/02 280/204
5,941,011 A 8/1999 Baker
6,082,753 A 7/2000 Kotlier
6,135,487 A * 10/2000 Flannery ..... B62B 7/08 280/642
6,135,668 A * 10/2000 Lin ..... B62K 15/006 280/278
6,151,756 A * 11/2000 Czipri ..... B63B 17/02 16/361
6,223,366 B1 * 5/2001 Cheng ..... A47D 13/063 16/326
6,238,125 B1 * 5/2001 Lin ..... B62B 7/06 403/102
6,257,261 B1 * 7/2001 Johnson ..... B60R 9/12 114/343
6,354,758 B1 3/2002 Chaulk
6,393,664 B1 * 5/2002 Habegger ..... E05D 11/1014 16/228
6,533,489 B1 * 3/2003 Zheng ..... A47C 4/286 403/101
6,722,812 B1 * 4/2004 Carletti ..... A61G 1/003 403/322.4
6,907,642 B1 * 6/2005 Czipri ..... B63B 17/02 114/364
6,928,766 B1 * 8/2005 Goebel ..... A01K 91/08 114/255
6,944,913 B2 * 9/2005 Henderson ..... B60J 7/1291 16/321
6,964,425 B2 * 11/2005 Turner ..... B62K 21/02 280/276
7,003,849 B2 * 2/2006 Cohen ..... A63C 11/221 16/232
7,007,344 B2 * 3/2006 Lee ..... E05D 11/0054 16/231
7,029,197 B2 * 4/2006 Lin ..... F16B 2/185 285/70
7,100,739 B2 * 9/2006 Parker ..... A47C 12/00 182/163
7,131,166 B2 * 11/2006 Cohen ..... A63C 11/221 16/232
7,254,869 B2 * 8/2007 You ..... A45B 19/10 135/29
7,340,801 B2 * 3/2008 Yamaguchi ..... E05C 17/32 16/324
7,380,311 B2 * 6/2008 Chen ..... A47D 13/063 16/326
7,481,438 B2 1/2009 Hernandez
7,614,097 B1 * 11/2009 Cheng ..... A47D 13/063 16/324
7,634,969 B2 12/2009 Neunzert et al.
7,661,747 B2 * 2/2010 Erskine ..... B63B 17/02 296/84.1
7,721,391 B2 * 5/2010 Bukovitz ..... B25G 3/14 15/145
7,735,431 B2 6/2010 Neunzert
7,774,901 B1 * 8/2010 Huang ..... B25G 1/04 16/113.1
7,984,531 B2 * 7/2011 Moore ..... A61F 5/0125 16/326
8,006,345 B1 * 8/2011 Bryce ..... E05D 11/1007 16/285
8,069,533 B2 * 12/2011 Yu ..... A47D 13/063 16/326
8,087,374 B2 * 1/2012 Porter ..... B63B 17/00 114/343
8,297,208 B2 * 10/2012 Hoffman ..... A47B 7/02 108/131
8,359,709 B2 * 1/2013 Van Gennep ..... E05D 11/1007 16/229
8,635,743 B2 * 1/2014 Smith ..... B62B 7/08 16/382
8,967,710 B2 * 3/2015 Hu ..... A47D 1/002 297/55
9,016,773 B2 * 4/2015 Tanner ..... E05D 11/10 16/296
9,032,983 B2 * 5/2015 Jin ..... E04H 15/48 135/120.3
9,096,291 B2 * 8/2015 Perosino ..... F16B 1/00
9,169,680 B2 * 10/2015 Kim ..... E05D 3/02
9,365,264 B2 * 6/2016 Perosino ..... F16B 1/00
9,371,108 B2 * 6/2016 Bettin ..... B62K 15/006
2002/0064417 A1 * 5/2002 Feng ..... G05G 5/06 403/102
2002/0076266 A1 * 6/2002 Mandon ..... A63C 11/221 403/102
2004/0036222 A1 * 2/2004 Chou ..... A63B 63/004 273/407
2006/0016047 A1 * 1/2006 Blackman ..... B25G 1/04 16/231
2009/0057505 A1 * 3/2009 Chen ..... B62K 15/006 248/185.1
2009/0119877 A1 * 5/2009 Garrett ..... E05D 11/00 16/319
2011/0272923 A1 * 11/2011 Chen ..... B62B 7/083 280/649
2013/0239872 A1 * 9/2013 Perosino ..... F16B 1/00 114/361
2013/0243520 A1 * 9/2013 Perosino ..... F16B 1/00 403/83
2014/0140756 A1 * 5/2014 Bettin ..... B62K 15/006 403/110
2015/0291259 A1 * 10/2015 Perosino ..... F16B 1/00 114/361
2015/0321729 A1 * 11/2015 Poppell ..... B63B 17/04 114/354

* cited by examiner

HINGE

FIELD OF THE INVENTION

The present invention relates generally to the field of hinges. More particularly, the present invention relates to hinges in structures such tubes, pipes, bars, etc.

BACKGROUND

The use of collapsible structures is desired in a number of industries. One use of collapsible structures that can be found in many industries is for protection from the elements or weather, such as the sun, wind or rain. For example, in the marine industry, watercraft users utilize structures sometimes called bimini tops to protect the occupants of the watercraft from exposure to the elements. Other examples include tents and canopies.

As with most weather related accessories, the ability to employ the structure in undesirable weather and collapse and store the structure in desirable weather is advantageous. In the marine industry, the ability to easily deploy, properly tension the fabric and stow a structure, such as a bimini, is additionally advantageous for variety of other reasons such as when going under a low bridge, when in a boat lift, when adding a boat cover, etc. Therefore, there is a need for a structure that can moved between a deployed position and stowed position quickly and easily.

In the marine industry, some current biminis use a series of 'U' shaped structural members. These biminis can be difficult and/or inconvenient to stow on a marine vehicle or, when removed from the marine vehicle, in storage because they can be large, heavy and/or have an awkward shape. Some such biminis use tubing and hardware such as pull pins, sliding sleeves, inserts, screws or freely articulating hinges. Such hardware is not ideal. Pull pins and sliding sleeves often require the user to both hold the bimini in the desired location and secure the hardware. Freely articulating hinges can allow a lot of play or movement when deployed and the watercraft is in motion. These disadvantageous are not only inconvenient, but can also create safety issues. Further, sometimes the optimum place for such hardware from an engineering or production perspective is a less than ideal place from a convenience or ease of use perspective.

Further, the boating industry includes many recreational users. Recreational users may choose not to deploy such covers or enclosures or, worse yet, deploy them contrary to the manufacturer's instructions, so as to avoid the frustration and difficulty. Such use can be unsafe and/or result in damage to the cover or enclosure.

As such, there is a need for a frame with hardware that is easy and quick to engage and disengage, thereby making the frame easier and quicker to deploy and collapse.

Although the above example describes a type of a bimini top, other marine tops and accessories such as covers have similar issues as do other collapsible accessories in many different industries.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

SUMMARY OF THE INVENTION

In one embodiment, the invention provides a hinge for use in attaching two structures of a frame, such as a frame from a collapsible bimini top, tent or canopy. The hinge includes a first portion having a recess formed therein and a first end adapted to attach the first portion to a first structure. The hinge also includes a second portion having a first end adapted to attach the second portion to a second structure. The second portion is pivotally attached to the first portion. A lock is attached to the second portion. The lock is movable between a first position and a second position. When the lock is in the first position, the first portion cannot be pivotally rotated with respect to the second portion. When the lock is in the second position, the first portion can be pivotally rotated with respect to the second portion.

In another embodiment, a collapsible accessory includes a frame having at least a first structure, a second structure and a hinge. The hinge is located between and attached to the first and second structures. The hinge includes a forked body portion and a tanged body portion that is received in and pivotally connected to the forked body portion. The hinge also includes a hook movably connected to one of the forked body portion and tanged body portion and an indentation formed in the one of the forked body portion and tanged body portion not movably connected to the hook. When the hook is engaged with the indentation, the collapsible accessory is prevented from collapsing. When the hook is disengaged from the indentation, the collapsible accessory can collapse.

In another embodiment, a hinge includes a first body having a latch and a second body attached to the first body and having a catch. When the latch is retained by the catch, the first body cannot move with respect to the second body. When the latch is free from the catch, the first body can move with respect to the second body.

In another embodiment, the invention provides a hinge for pivotally connecting a first structure to a second structure. The hinge includes a first portion and a second portion. The first portion includes a fork that has a first bore formed therein, a cavity and a first boss. The first boss is adapted to receive the first structure which is secured to the first boss by a first fastener. The second portion includes a tang that has a second bore formed therein, a socket and a second boss. The second boss is adapted to receive the second structure which is secured to the second boss by a second fastener. The hinge also includes a first pin, a latch and a spring. The first pin is received within the first bore and second bore when the tang is within the fork. The latch is pivotally attached to the second portion, is sized to fit within the cavity and includes a hook. The spring is received within the socket and exerts a force on the latch such that the latch is urged towards a locked position. The latch is movable between the locked position and an unlocked position. In the locked position, the hook is engaged in the cavity and the second portion cannot rotate pivotally with respect to the first portion. In the unlocked position, the hook is disengaged from the cavity and the second portion can rotate pivotally with respect to the first portion.

Other objects and advantages of the invention will become apparent hereinafter.

DETAILED DESCRIPTION

A hinge 10 in accordance with the present invention is used for easily and quickly deploying or collapsing an accessory, frame or structure(s).

Figure 1:
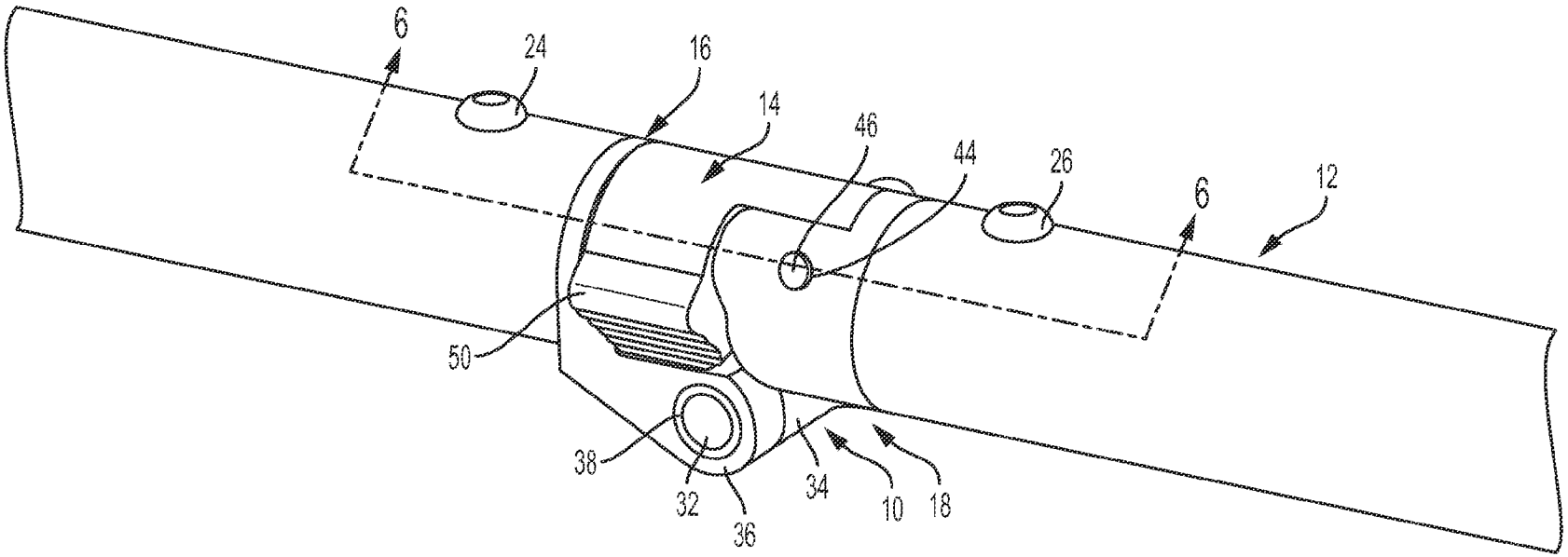
FIG. 1 is a perspective view of a hinge in a locked position attached to a fully deployed structure in accordance with one embodiment of the present invention.
Figure 2:
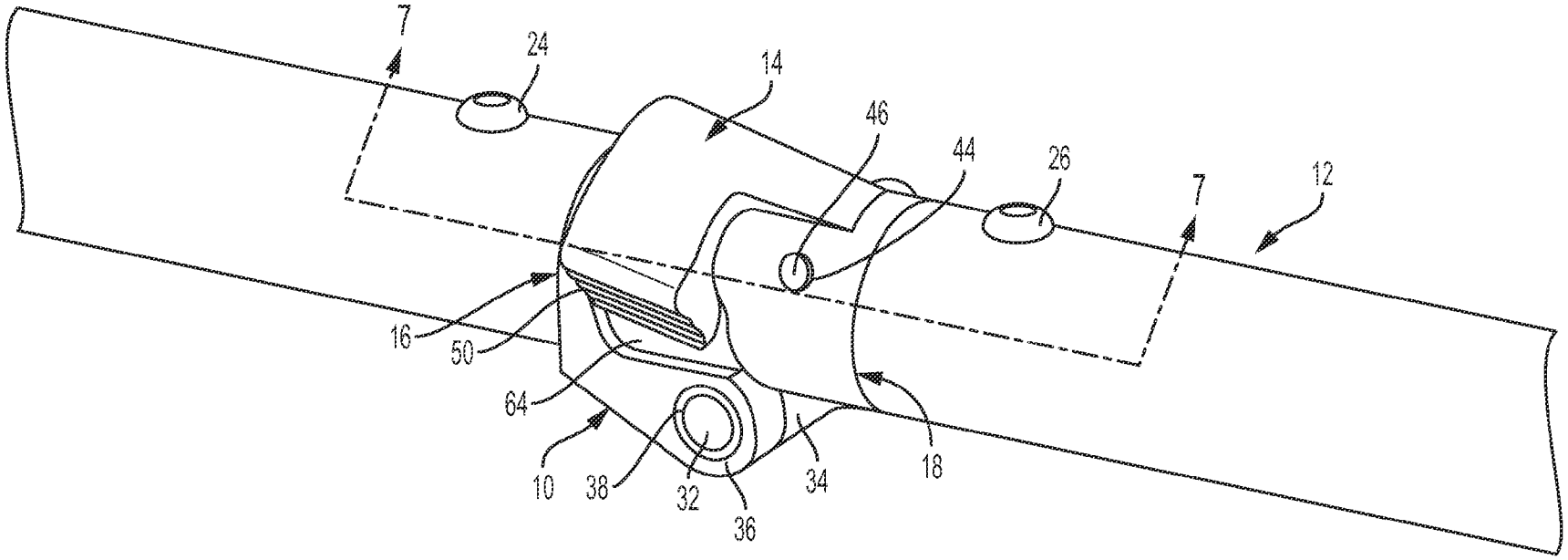
FIG. 2 is a perspective view of the hinge in FIG. 1 in an unlocked position.
Figure 3:
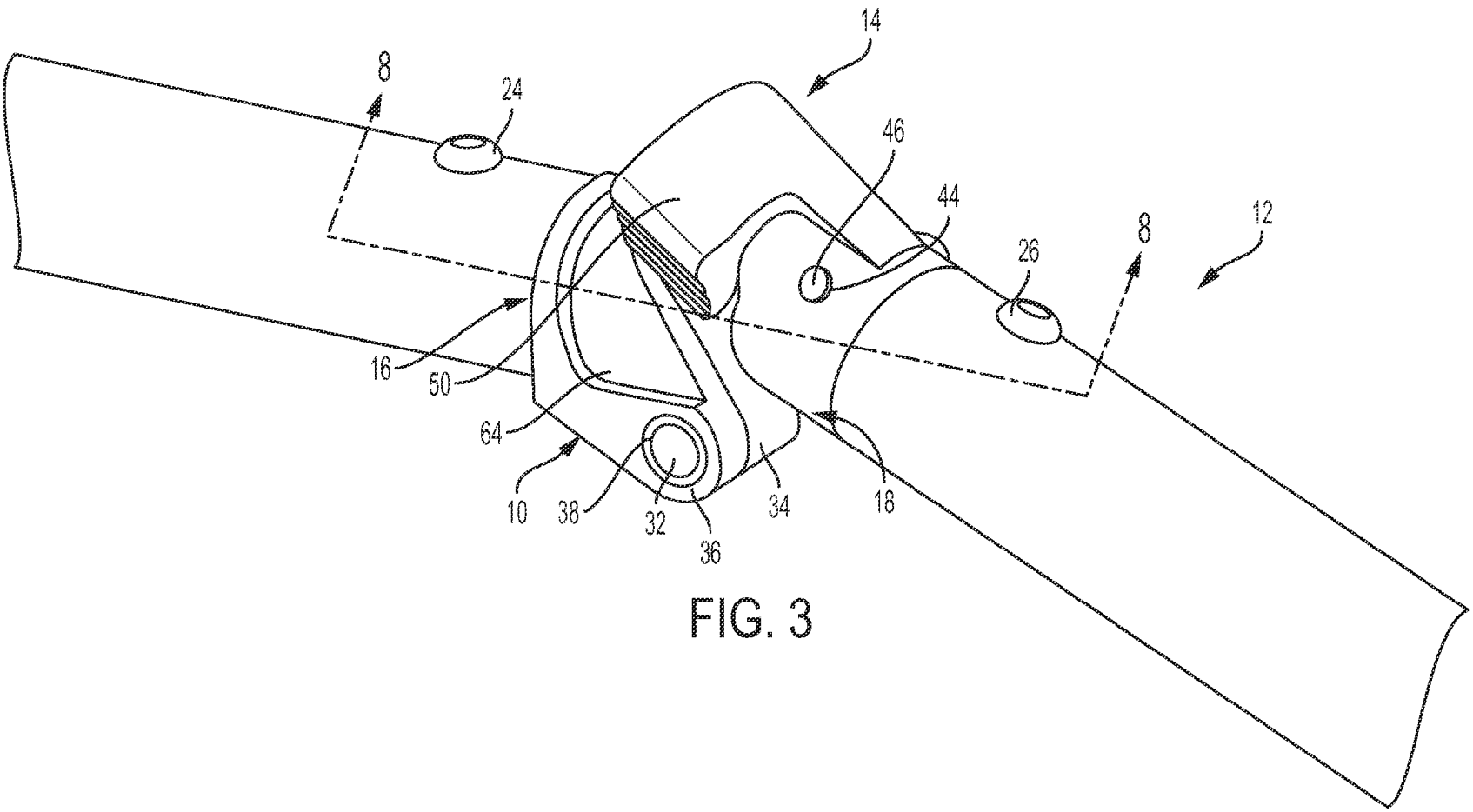
FIG. 3 is a perspective view of the hinge in FIG. 1 in an unlocked position and the structure partially collapsed.
Figure 4:
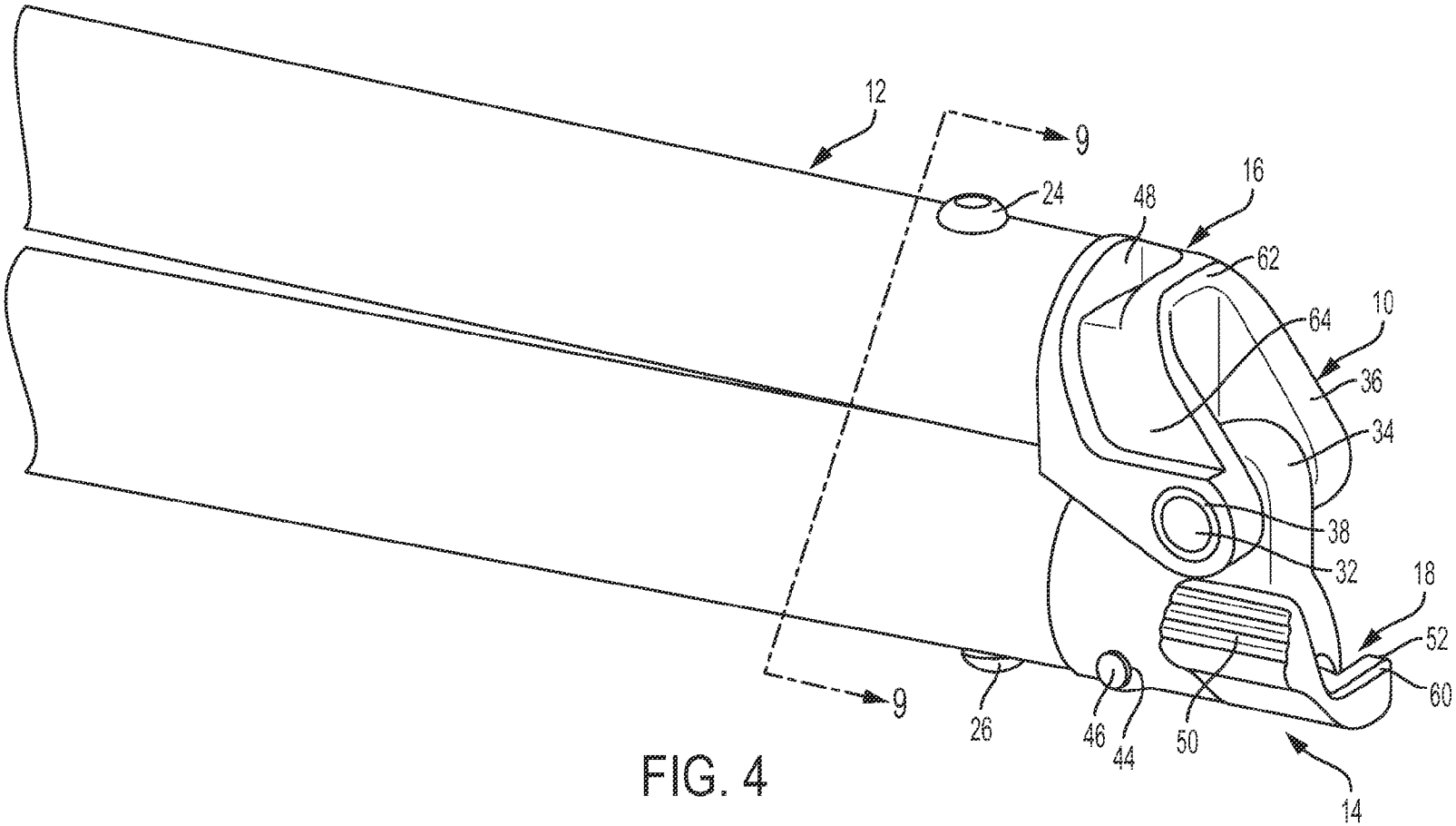
FIG. 4 is a perspective view of the hinge in FIG. 1 in an unlocked position and the structure in a fully collapsed position.

As seen in FIGS. 1-4, the hinge 10 is designed to cooperate with a circular tube, although the hinge could be adapted to fit a variety of shapes and sizes, both hollow and solid. When the hinge is locked or engaged, as can be seen in FIG. 1, the tubular frame 12 is rigid and can withstand a variety of forces acting upon the tubular structure. To disengage or unlock the hinge and collapse the frame 12, a lock or latch 14 can be moved to an unlocked position as seen in FIG. 2. Once the latch is unlocked, the frame can be fully collapsed as seen in FIG. 4. Although FIG. 4 shows the frame 12 folded in half, or such that the first structure 12*a* of the frame is generally perpendicular to the second structure 12*b* of the frame, the range of motion can be set to any desired range by a number of means known in the industry for example, modifying how the hinge contacts itself when in a fully collapsed position.

Figure 5:
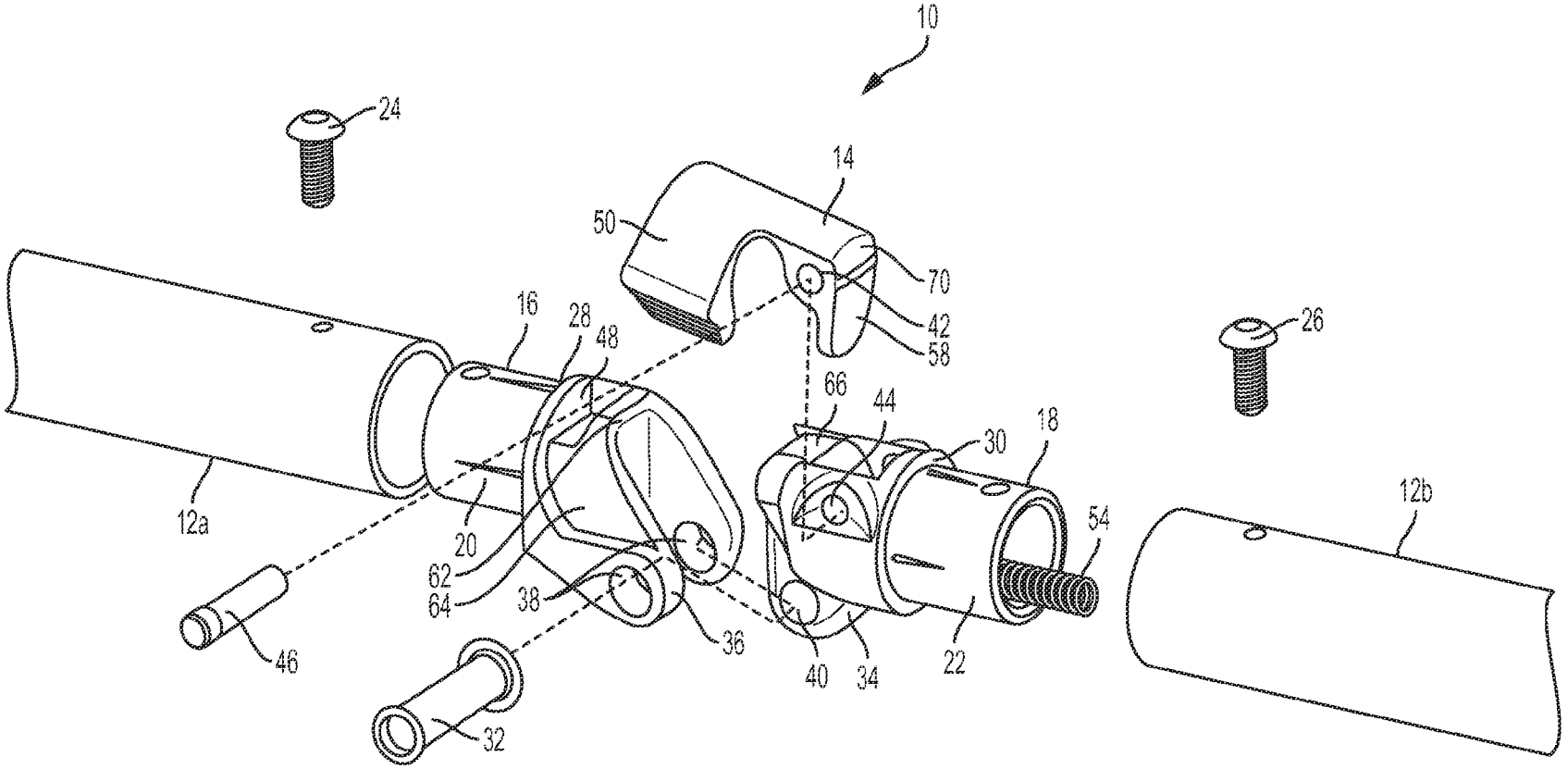
FIG. 5 is an exploded view of a hinge in accordance with one embodiment of the present invention.

As can be more clearly seen in FIG. 5, the hinge 10 has a first body or portion 16 and a second body or portion 18. The first body 16 of the hinge 10 is connected or attached to a first part of the structure 12*a* at a first end and the second body 18 of the hinge is connected or attached to a second part of the structure 12*b* at a first end. In the embodiment shown in FIG. 5, the first body 16 and second body 18 have a first boss 20 and a second boss 22 that slide into the hollow portion of the structures 12*a-b*, respectfully. Although the hinge 10 is shown attached to the structure 12 by inserting a portion of the hinge into the structure, other means of connecting two such structures are known in the art, such as by the insertion of the structure into the hinge, integrally forming or over molding the hinge to the structure, etc., the use of which would not defeat the spirit of the invention.

Figure 6:
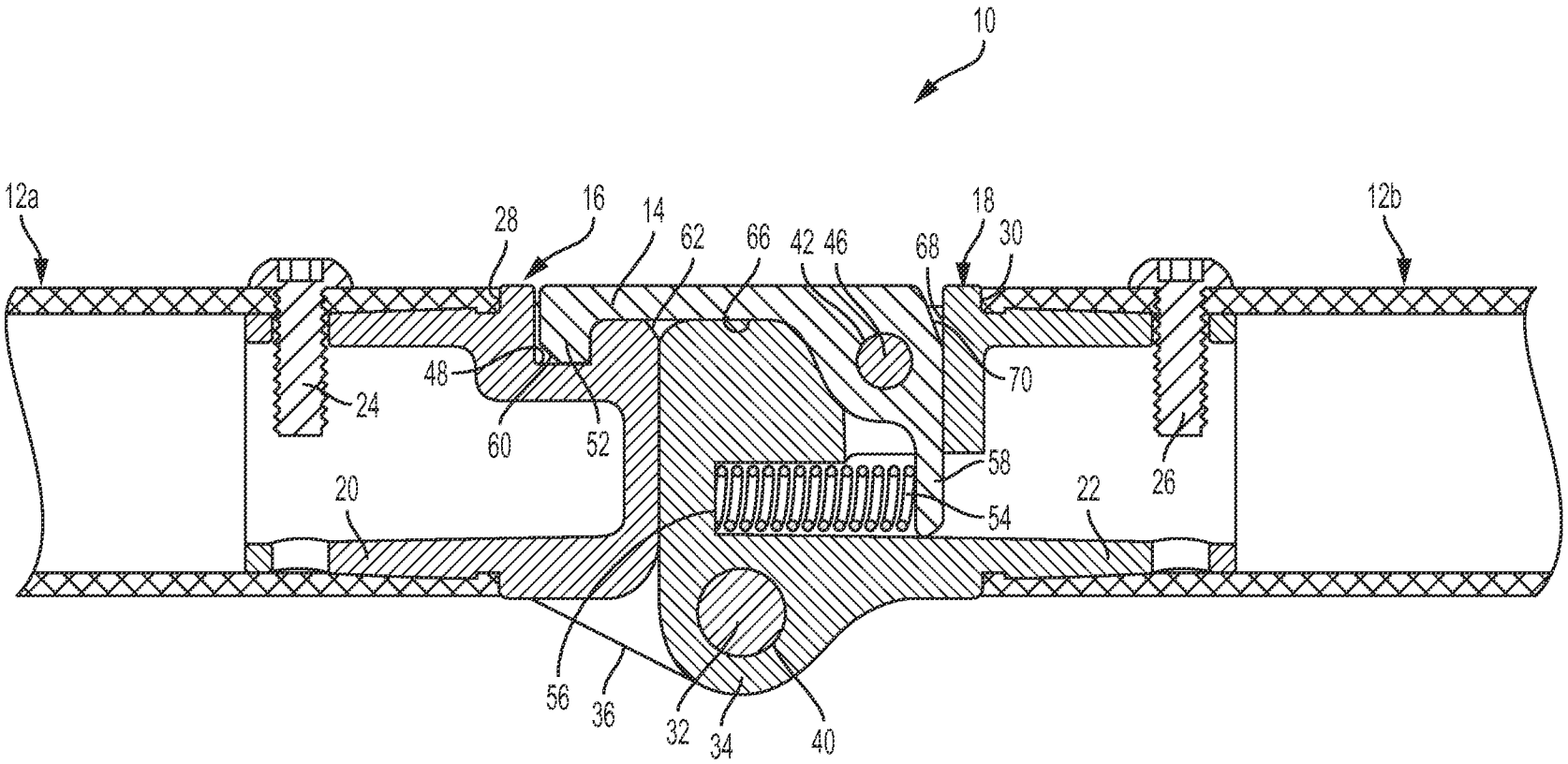
FIG. 6 is an elevation cross-sectional view of the hinge of FIG. 1 in an engaged position attached to a fully deployed frame in accordance with one embodiment of the present invention taken along the line 6-6.

The first and second bodies 16, 18 are, in the embodiment shown in FIG. 5, connected to the structures 12*a*, 12*b* by screws 24, 26. However, other fasteners are known for connecting two such structures such as, for example, adhesive, riveting, welding, threading, heat shrinking, staking, crimping, etc., the use of which would not defeat the spirit of the invention. As seen in FIG. 6, the first and second bodies 16, 18 may also include a first and second shoulder 28, 30 by the first and second bosses 20, 22, respectively, that promote and facilitate easy and quick installation and/or attachment of the bosses with the structures 12*a*, 12*b* by, for example, setting the depth at which the bosses are inserted into or received by the structures, aligning the holes in the bosses and structures for insertion of a screw 24, 26, etc. In one embodiment, the bosses 20, 22 are hollow to allow for blind fastening and access to the internal components of the hinge 10 described below.

The first body 16 and second body 18 are connected, such as, for example by a pin 32 so as to be pivotally attached. In the embodiment shown in FIG. 5, the second or tanged body portion 18 of the hinge 10 has a protrusion 34 that is received in the forked protrusion 36 of the first or forked body portion 16. The protrusion 34 has a first bore 38 and the forked protrusion 36 has a second bore 40 such that when the first or forked body portion 16 and second body 18 are properly aligned, the pin 32 can bet set in the bores to hold and pivotally connect the first and second bodies together. The pin 32 is also the axis about which the hinge 10 may rotate when unlocked.

The latch 14 may also be attached to the hinge by means of a pin. As seen in FIG. 5, the latch 14 has a first hole or bore 42 that corresponds to a second hole or bore 44 in one of the bodies, in the embodiment shown in FIG. 5, the second body 18. The latch 14 can be pivotally attached to the second body 18 by inserting a second pin 46 through the first hole 42 and into the second hole 44. Thereby, the latch 14 may be rotated about an axis which is, in the example shown in FIG. 5, through the second pin 46. The second pin 46, like the first pin 32, can be secured by a variety of methods known in the industry, such as, for example, riveting, gluing, spring tension, through a designed interference within one of the first and second bodies 16, 18, etc., the use of which would not defeat the spirit of the invention. Although the latch is shown attached to the second body 18, the latch could be movably attached to either the first 16 or second body 18 or frame 12.

Figure 7:
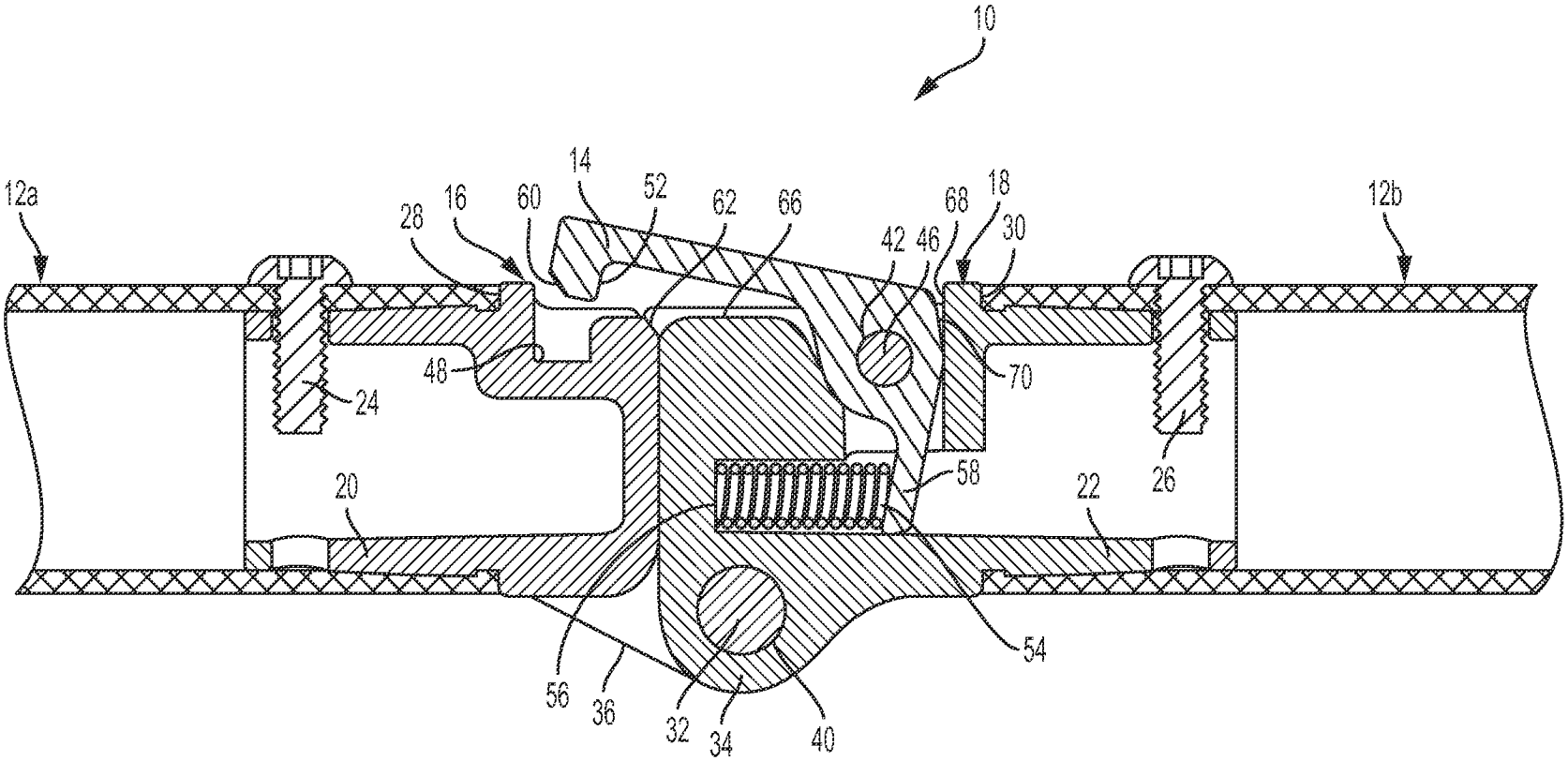
FIG. 7 is an elevation cross-sectional view of the hinge in FIG. 2 in a disengaged position taken along the line 7-7.
Figure 8:
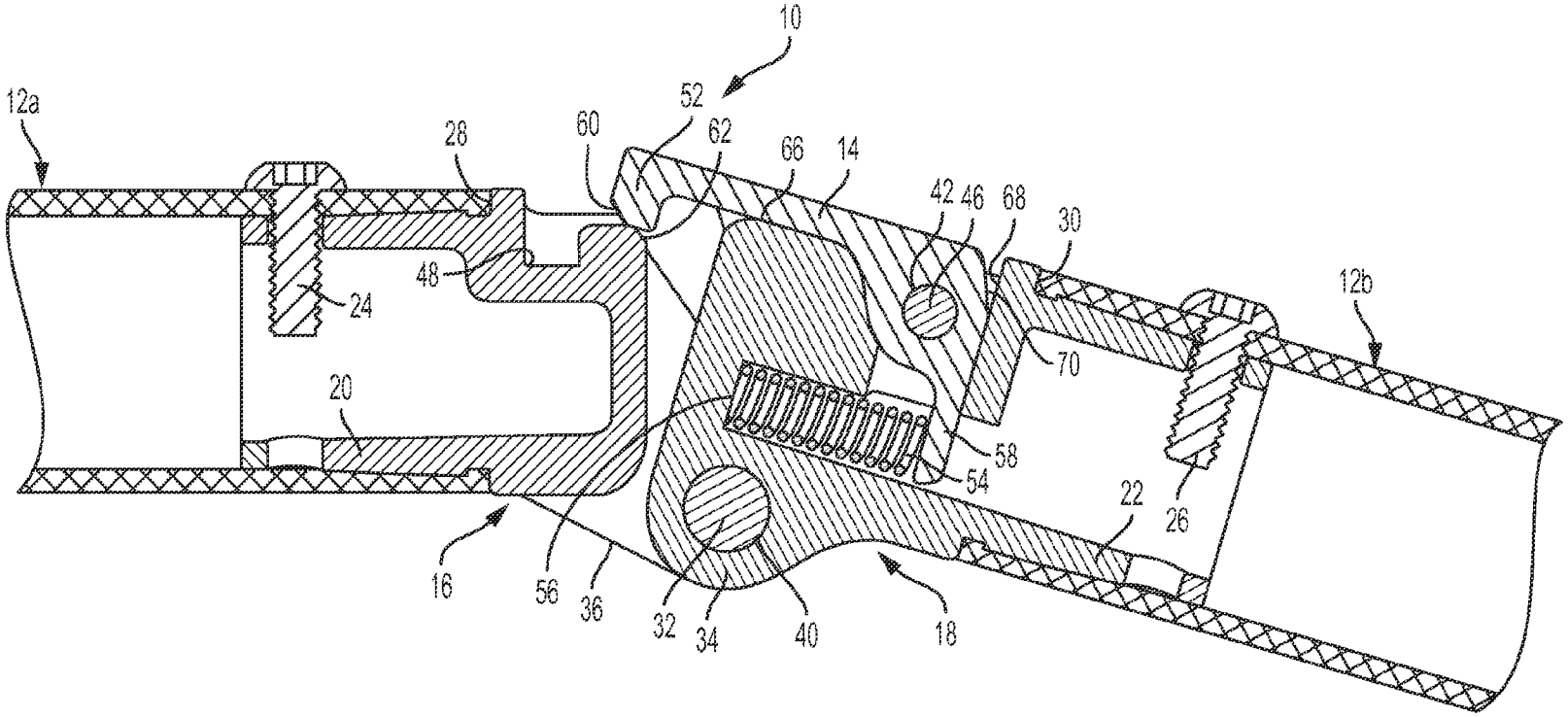
FIG. 8 is an elevation cross-sectional view of the hinge in FIG. 3 in a disengaged position and partially unfolded taken along the line 8-8.
Figure 9:
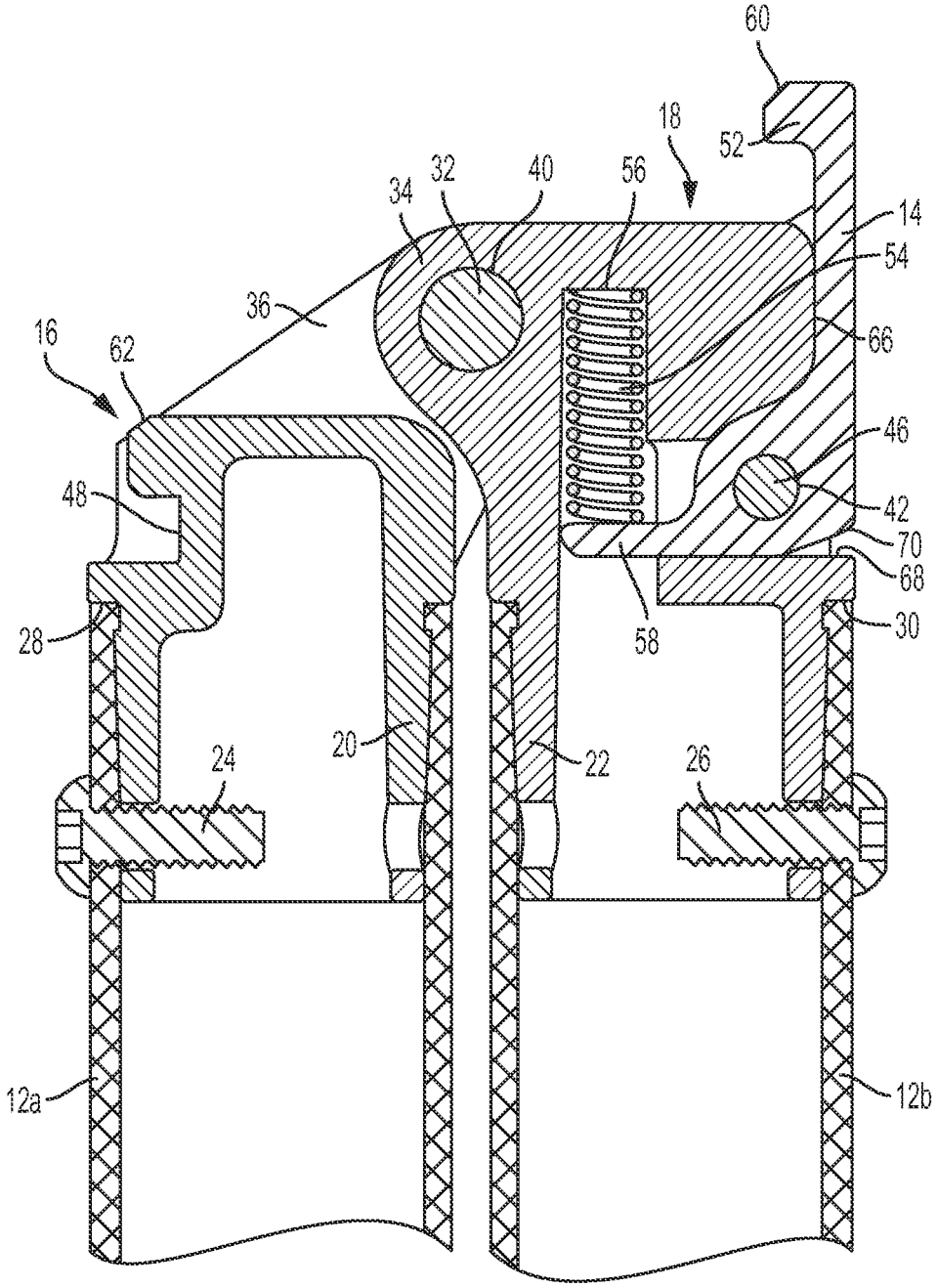
FIG. 9 is an elevation cross-sectional view of the hinge in FIG. 4 in a disengaged position and in a fully unfolded position taken along the line 9-9.

The latch 14 is movable between a first, engaged or locked position as seen in FIG. 6 and a second, disengaged or unlocked position as seen in FIGS. 7-9. When the latch 14 is in the locked position, as seen in FIG. 6, the structures, 12*a*, 12*b* are generally aligned and the hook at least partially resides, is located or engaged in or retained by a cavity, recess or catch 48 formed in the first body 16. In the locked position, the first body 16 cannot move or pivotally rotate relative to the second body 18 and the structures 12*a*, 12*b* and hinge operate as single rigid structure. Although the recess or indentation 48 is shown attached to the first body 16, the recess could be formed in either the first 16 or second body 18 as long as it is opposite the body with the latch 14.

To move the latch 14 to the unlocked position, the latch can be rotated clockwise, such as by using a grasp 50, as seen most clearly in FIGS. 1-4. As the latch 14 is rotated clockwise, the hook 52 is lifted out of or disengaged from the cavity 48. With the hook 52 free of the cavity 48, as seen in FIGS. 7-9, the first body 16 is free to move or pivotally rotate on the pin 32 with respect to the second body 18, as seen in FIGS. 8-9.

The hinge 10 may also use a means for biasing, such as a coil spring, leaf spring, gas spring, damper, elastic, etc., to urge the latch 14 into the locked position. In the embodiment shown in FIG. 6, the spring 54 resides in an enclosure or socket 56 in the second body 18. One end of the spring 54 abuts the wall of the enclosure 56 and the second end of the spring contacts and thereby, applies a force to a lever portion 58 of the latch 14. When no external force is acting on the latch 14, for example, a user is not using the grasp 50 to disengage the latch, the force from the spring 54 acting on the lever 58 urges the latch in a counterclockwise direction and into the locked position wherein the hook 52 is in engagement with the catch 48 as is seen in FIG. 6.

The hook 52 of the latch 14 can have a first chamfered edge 60 to further promote the latch into the locked position. The first or second body 16, 18 in which the cavity 48 resides, can similarly have a second chamfered edge 62. When the hinge 10 is in the fully unlocked position, for example, as seen in FIG. 9, there is no external force acting on the latch 14. Therefore, the force from the spring 54 acting on the lever 58 of the latch causes the latch, but not the hinge, to be in the locked position because the hook 52 is not yet in the cavity 48. When the hinge 10 is rotated sufficiently, the chamfered edge 60 of the latch 14 will contact the chamfered edge 62 of the first body 16. The interaction of the chamfered edges 60, 62 will allow the latch 14 to slide up and over the chamfered edge 62 of the first body 16 just from the external force applied by a user rotating the structures 12*a*, 12*b* such as can be seen in FIG. 8. When the hook 52 reaches the cavity 48, the force from the spring 54 acting on the lever 58 of the latch 14 will cause the latch to rotate such that the hook engages the cavity and the hinge 10 is in the locked position. The amount of force required to be applied to the hinge 10 to overcome the interaction of the chamfered edges 60, 62 can be set, at least in part, by the strength of the spring 54.

When it is desired to unlock the latch 14, a force must be applied to the latch, for example, by using the grasp 50, with sufficient force so as to overcome the force from and compress the spring 54, as is seen in FIG. 7. After the hook 52 is withdrawn from the cavity 48, the latch, and grasp 50, can be released and the hinge operated into the collapsed or folded position as is seen in FIG. 9.

The first or second body 16, 18 in which the cavity 48 resides, can also have a recessed portion 64, as seen in FIG. 5. The recessed portion 64 provides clearance for the latch 14 when the latch is in the locked position such that the hinge 10 maintains the general profile of the structure 12 on the latch side of the hinge, as seen in FIG. 1.

The first or second body 16, 18 to which the latch 14 is attached can be shaped such as to prevent over rotation by the latch when locked and/or unlocked. As can be seen in FIGS. 6 and 8-9, the second body 18 has a first stop surface 66 that prevents the force from the spring 54 from over-rotating the latch towards the locked position. The first stop surface 66 also helps align the latch 14 such that the hinge 10 can self-lock. For example, in FIG. 8, the first stop surface 66 also helps align the latch 14 so that the first chamfered edge 60 contacts the second chamfered edge 62. As the hinge 10 is further rotated, the hook 52 will ride up and over the second chamfered edge 62 and into the cavity 48 to lock the hinge.

The second body 18 can similarly have a second stop surface 68 that prevents the latch 14 from being over-rotated when operated by a user, as can be seen in FIG. 7. The latch 14 can also have a contact surface 70 that, in cooperation with the second stop surface 68, can be configured to limit the extent of rotation of the latch away from the locked position.

Figure 10:
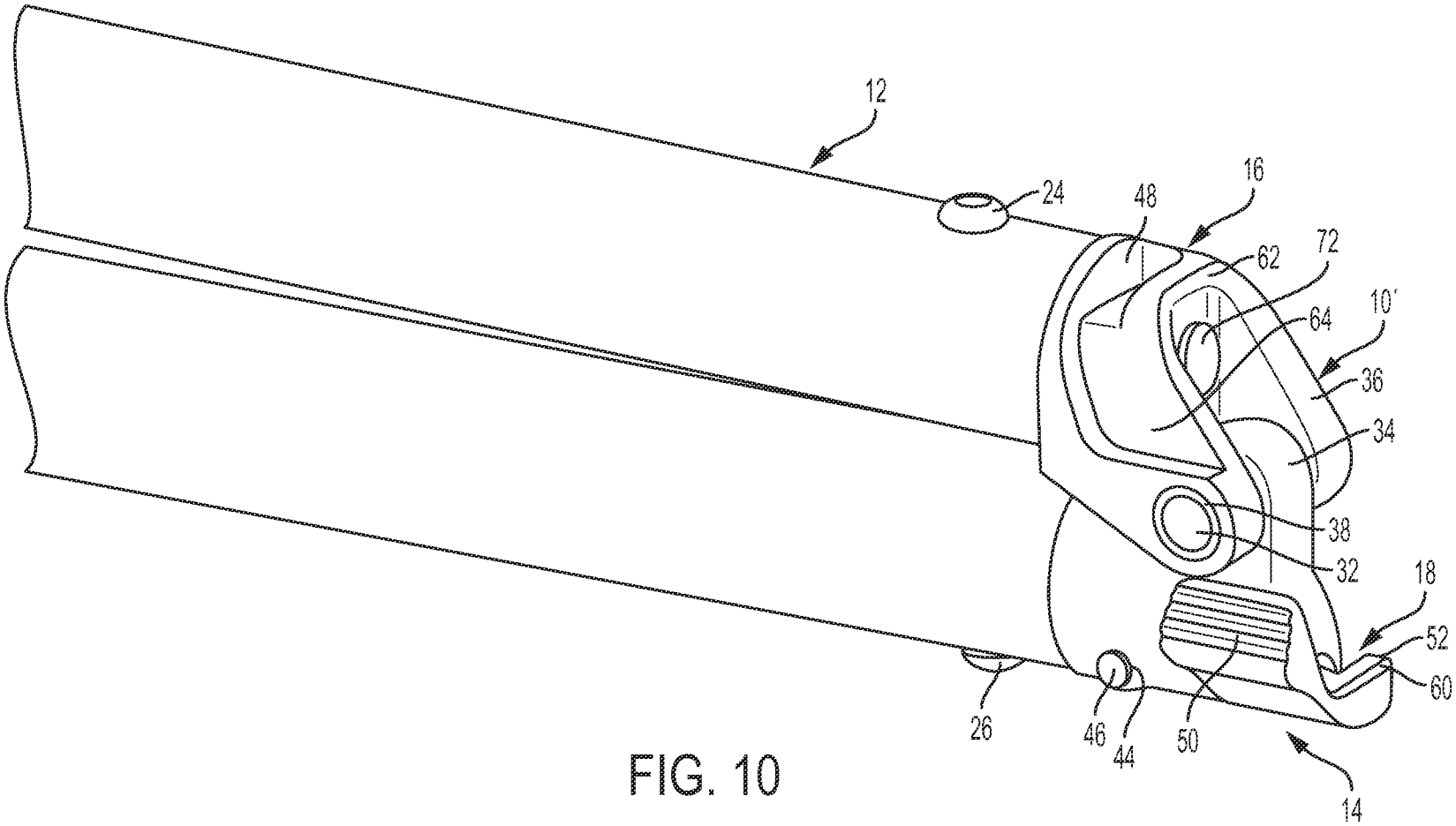
FIG. 10 is a perspective view of a hinge in an unlocked position and the structure in a fully collapsed position in accordance with one embodiment of the present invention.
Figure 11:
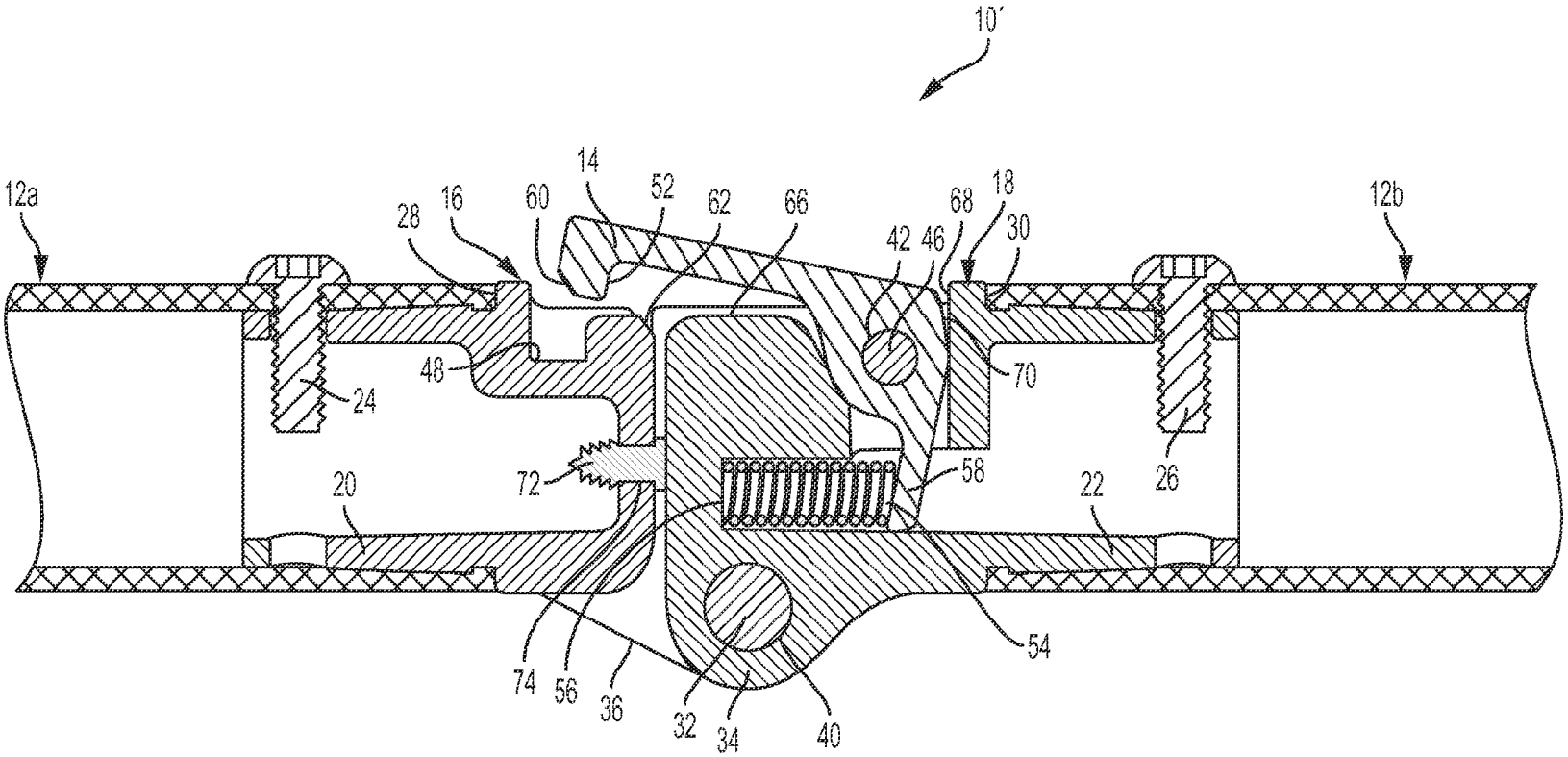
FIG. 11 is an elevation cross-sectional view similar to FIG. 7, but of the hinge of FIG. 10 in a disengaged position.

In alternative hinge embodiment seen in FIGS. 10-11, the hinge 10' includes a bumper 72 to create a soft contact between the first and second bodies 16, 18 when the hinge is moved to the locked position. The bumper 72 also helps to prevent rattling when the hinge 10' is in the locked position by putting the first and second bodies 16, 18 in compression between the structures 12*a*, 12*b* and the bumper. When the hinge 10' is moved to the locked position, the bumper 72 can dampen the sound by eliminating any contact between the first body 16 and second body 18. The bumper 72 can also help mitigate minor deviations and allow for minor tolerances during manufacture and/or assembly of the hinge 10'.

As seen in FIG. 11, the bumper 72 is of a Christmas tree insert style and is inserted into an opening 74 in the first body 16. When the first and/or second bodies 16, 18 are rotated toward one another and the hinge 10' is rotated towards the locked position, the second body will contact the bumper and the bumper will compress such that the hinge 10' can lock.

Although the bumper 72 is shown attached to the first body 16, the bumper could also or instead be attached to the second body 18. Further, the bumper 72 could also be attached to the first and/or second bodies 16, 18 through a number of known ways for attaching a bumper including threading, heat shrinking, staking, screwing, adhering, integrally forming or over molding the bumper the first and/second body, the use of which would not defeat the spirit of the invention.

The main components of the hinge 10, for example, the first and second body 16, 18, the latch 14 and pins 32, 46 could be manufactured through many methods known in the industry, including injection molding, casting or 3D printing, from a variety of materials including metals and plastics.

Figure 12:
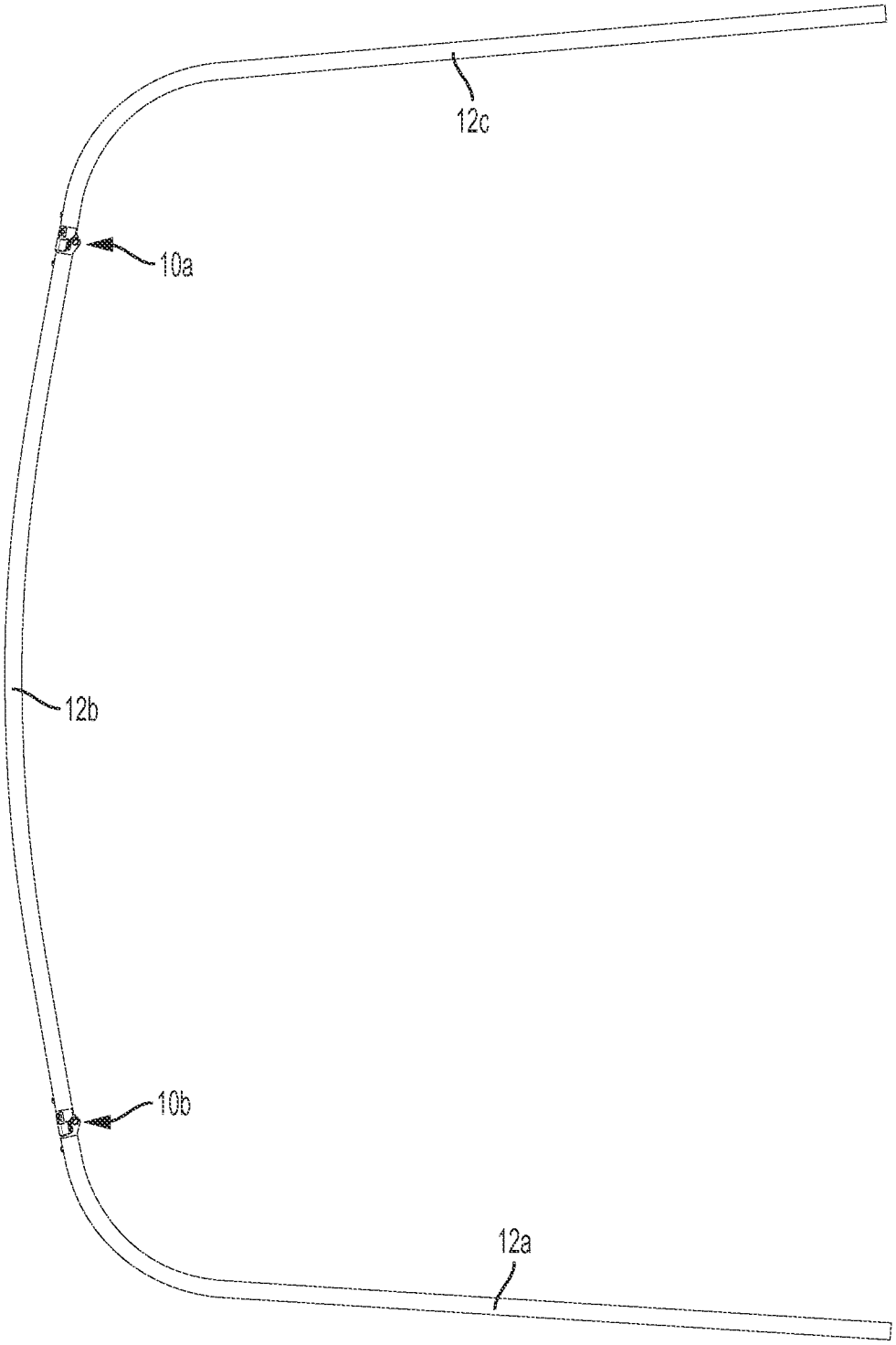
FIG. 12 is an elevation view of a 'U' shaped frame with multiple hinges in an un-collapsed position.
Figure 13:
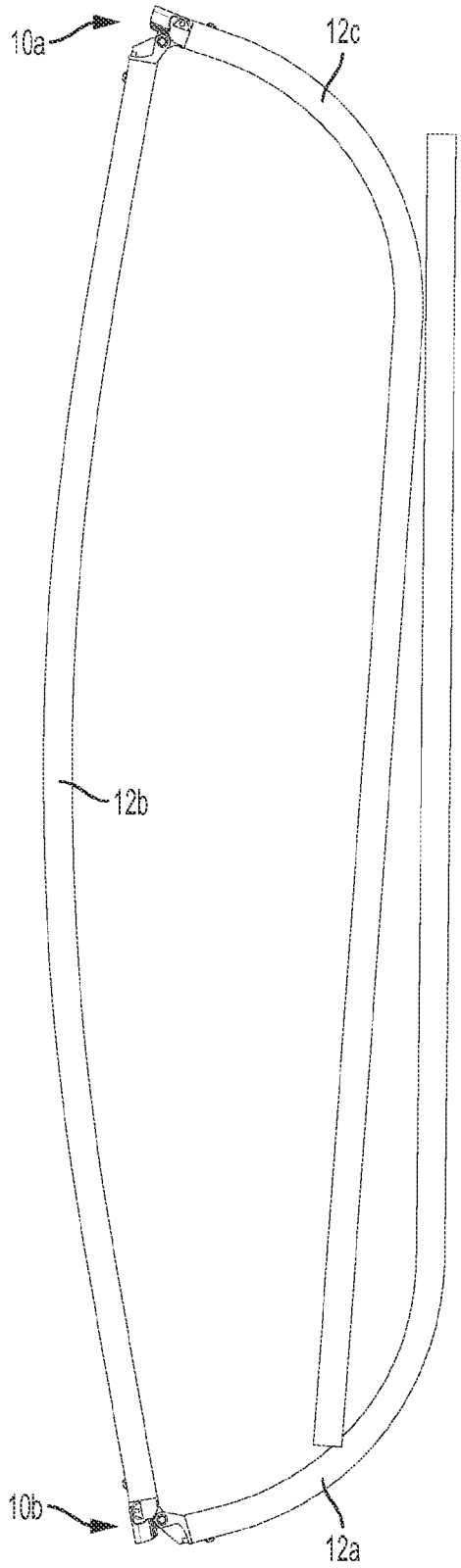
FIG. 13 is an elevation view of a 'U' shaped frame with multiple hinges in a collapsed position.

Applications for the hinge 10 of the present invention are numerous and wide-varied. For example, the hinge could be used in a number of collapsible accessories such as tents, camera tripods, baseball pitching screens, display easels, or shade structures such as canopies. In the marine industry, the hinge could be used on frame members for shades, such as bimini tops, or other enclosures. In a bimini top, one or more hinges, for example 10*a-b*, could be used on an 'U' shaped frame between several structural members 12*a-c*, as seen in FIGS. 12-13, or a locking strut to support a top frame. These are just a few examples of the variety of uses of such a hinge.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A hinge comprising:

a first portion having a catch;

a second portion having a longitudinal axis, wherein the second portion is pivotally attached to the first portion;

a lock having a lever and a hook and pivotally attached to the second portion, the lock being movable between a first position wherein the hook is engaged in the catch and the first portion cannot be pivotally rotated with respect to the second portion and a second position wherein the hook is disengaged from the catch and the first portion can be pivotally rotated with respect to the second portion;

a means for biasing the lock towards the first position by biasing the lever, the means for biasing positioned within the second portion and having a longitudinal axis that is parallel to the longitudinal axis of the second portion.

2. The hinge of claim 1 wherein the means for biasing the lock is at least partially located within an enclosure in the second portion.

3. The hinge of claim 1 wherein when the lock is in the second position, the first structure can be moved to a position that is generally parallel to the second structure.

4. The hinge of claim 1 wherein the second portion has a first stop surface and a second stop surface and wherein the first stop surface prevents the lock from rotating beyond the first position and the second stop surface prevents the lock from rotating beyond the second position.

5. The hinge of claim 1 wherein a first end of the first portion includes a first boss and a first end of the second portion includes a second boss.

6. The hinge of claim 5 wherein the first boss is configured to be received at least partially within the first structure and the second boss is configured to be received at least partially within the second structure.

7. The hinge of claim 1 wherein the first portion includes a first shoulder configured to facilitate attachment of the first portion to the first structure and the second portion includes a second shoulder configured to facilitate attachment of the second portion to the second structure.

8. A collapsible accessory comprising:

a frame having at least a first structure and a second structure; and a hinge located between and attached to the first and second structures, the hinge further comprising:

a forked body portion;

a tanged body portion, wherein the tanged body portion is received in and pivotally connected to the forked body portion; and a latch pivotally connected to one of the forked body portion and tanged body portion, the latch having a hook and a lever portion, the lever portion extending from the latch and generally parallel to the hook;

a biasing means engaging the lever portion, the biasing means having a longitudinal axis; and an indentation formed in the one of the forked body portion and tanged body portion not pivotally connected to the latch, wherein the collapsible accessory is prevented from collapsing when the hook is engaged with the indentation and the collapsible accessory can collapse when the hook is disengaged from the indentation; and wherein the longitudinal axis of the biasing means is parallel to a longitudinal axis of the hinge when the collapsible accessory is prevented from collapsing.

9. The collapsible accessory of claim 8 wherein the hook is pivotally connected to the one of the forked body portion and tanged body portion by a pin.

10. The collapsible accessory of claim 8 wherein the biasing means is a spring and wherein the hook is urged into engagement with the indentation by force from the spring.

11. A hinge comprising:

a first body having a latch, the latch is pivotally connected to the first body, at least a portion of the latch extends inside the first body, a grasp connected to a first end of the latch, and a hook portion extending from the first end of the latch;

a second body attached to the first body and having a catch; and a biasing means having a longitudinal axis and located entirely within the first body and exerting a force on a second end of the latch, wherein the force urges the latch into retention with the catch;

wherein when the latch is retained by the catch, the first body cannot move with respect to the second body and when the latch is free from the catch, the first body can move with respect to the second body; and wherein the latch is movable from retention by the catch to being free from the catch when the grasp is lifted upwards, and wherein the longitudinal axis of the biasing means is parallel to a longitudinal axis of the first body.

12. The hinge of claim 11 wherein the movement of the first body with respect to the second body is rotational movement about an axis through the attachment of the first body to the second body.

13. The hinge of claim 11 wherein when the latch is engaged with the catch, the hook portion is located at least partially within the catch.

14. The hinge of claim 13 wherein the hook portion has a first chamfer that corresponds to a second chamfer on the second body to locate the hook portion in the catch when the latch is being moved from an unlocked position wherein the latch is free from the catch to a locked position wherein the latch is retained by the catch.

15. The hinge of claim 11 further comprising a bumper attached to one of the first body and second body.

16. A hinge for pivotally connecting a first structure to a second structure, the hinge comprising:

a first portion with a fork, a cavity, a recessed portion formed in an outer surface of the first portion and a first boss, the first boss adapted to receive the first structure, wherein the first structure is secured to the first boss by a first fastener and the fork has a first bore formed therein;

a second portion with a tang, a socket and a second boss, the second boss adapted to receive the second structure, wherein the second structure is secured to the second boss by a second fastener and the tang has a second bore formed therein;

a first pin received within the first bore and second bore when the tang is within the fork;

a latch with a hook, wherein the latch is pivotally attached to the second portion and the latch is sized to fit within the cavity and the recessed portion; and a spring received within the socket and exerting a force on the latch such that the latch is urged towards a locked position, the spring having a longitudinal axis;

wherein the latch is movable between the locked position in which the hook is engaged in the cavity and the second portion cannot rotate pivotally with respect to the first portion and an unlocked position in which the hook is disengaged from the cavity and the second portion can rotate pivotally with respect to the first portion;

wherein when the latch is in the locked position, the latch is seated in the recessed portion such that the latch is generally flush with the first portion and the second portion; and wherein the longitudinal axis of the spring is parallel to a longitudinal axis of the first portion and the second portion when the latch is in the locked position.

* * * * *